United States Patent [19]

Mullay

[11] 4,097,316

[45] Jun. 27, 1978

[54] METHOD FOR GELLING NITROPARAFFINS IN EXPLOSIVE COMPOSITIONS

[75] Inventor: John J. Mullay, Hazelton, Pa.

[73] Assignee: Atlas Powder Company, Tamaqua, Pa.

[21] Appl. No.: 777,694

[22] Filed: Mar. 15, 1977

[51] Int. Cl.[2] ..... C06B 45/00

[52] U.S. Cl. ..... 149/2; 149/38; 149/47; 149/62; 149/76; 149/78; 149/89; 149/92; 149/105

[58] Field of Search ..... 149/2, 89, 38, 47, 76, 149/62, 78, 92, 105

[56] References Cited

U.S. PATENT DOCUMENTS

| | | | |
|---|---|---|---|
| 3,377,217 | 4/1968 | Francis | 149/89 X |
| 3,377,218 | 4/1968 | Brown | 149/89 X |
| 3,762,970 | 10/1973 | Ballard et al. | 149/89 X |

*Primary Examiner*—Stephen J. Lechert, Jr.
*Attorney, Agent, or Firm*—Richards, Harris & Medlock

[57] ABSTRACT

An improved process for producing explosive gel compositions is provided wherein a polymeric thickening agent is dispersed in an aqueous medium and a nitroparaffin is added thereafter to form dispersed globules of nitroparaffin gel within the aqueous medium. Gelling agents for the aqueous medium, fuels and non-explosive sensitizing material can then be added to form an explosive gel with excellent storage and detonation capabilities.

49 Claims, No Drawings

METHOD FOR GELLING NITROPARAFFINS IN EXPLOSIVE COMPOSITIONS

BACKGROUND OF THE INVENTION

This invention relates to gelled explosive compositions. In another aspect, this invention relates to a method for producing explosive gel compositions which result in substantial savings in production time and energy requirements. In still another aspect, this invention relates to a method of producing an improved explosive composition containing a nitroparaffin gelled with a polymeric thickening agent selected from the organic esters of cellulose, methacrylate polymers, and copolymers of vinylidene chloride and acrylonitrile.

Explosive gel compositions are well known for their reliability, economy, and ease of handling. Accordingly, the demand for explosive gel compositions is great and improved methods of manufacture are desirable. Explosive gel compositions containing gelled nitroparaffin, an inorganic nitrate, and water are used in a variety of applications. Explosive gel compositions containing inorganic nitrates and nitroparaffins are disclosed in U.S. Pat. No. 3,419,444 and in U.S. Pat. No. 3,765,966. Both of these references disclose a method for producing explosive compositions which contain a gelled nitroparaffin. According to U.S. Pat. No. 3,419,444, the nitroparaffin gel is formed first by blending nitrocellulose with the nitroparaffin. The nitroparaffin gel is then added to a mixture of an inorganic nitrate, water, a gelling agent for the water, and non-explosive sensitizer materials, such as resin balloons. The major disadvantage of this process is that in order to obtain a sensitive composition, prolonged mixing times are necessary in order to disperse the preformed nitroparaffin gel within the aqueous gel which contains the inorganic nitrates and other materials. The long mixing time required renders this process commercially undesirable.

The process disclosed in U.S. Pat. No. 3,765,966 is an attempt to overcome the disadvantages described above by setting forth a one step process whereby an explosive gel composition can be formed without the necessity of prolonged mixing to disperse a preformed nitroparaffin gel. This reference discloses that the fluid medium (water or methanol) and the liquid nitromethane should be mixed together and the solid materials, such as the inorganic nitrates, non-explosive sensitizing materials, and water gelling agents should then be added and mixed with the fluid mixture. Additionally, this reference discloses that a specific type of gelling agent must be added with the solid materials in order to gel the liquid nitromethane. The nitromethane gelling agent is a cyanoethylether of galactomannan gum. This gelling agent is presently of uncertain availability and is relatively expensive. Furthermore, it is unclear from this reference whether this specific gelling agent will sufficiently gel nitroparaffins other than nitromethane. A process for producing gelled explosives containing gelled nitroparaffin which utilizes less expensive and more readily available nitroparaffin gelling agents is therefore needed. More specifically, a method for producing an explosive gel composition containing a nitroparaffin gelled with commercially available polymeric thickeners which are easily dispersible in an aqueous phase and which thicken the nitroparaffin without the necessity of prolonged mixing is desirable.

SUMMARY OF THE INVENTION

According to the invention, explosive gel compositions containing gelled nitroparaffins are produced utilizing polymeric thickening agents selected from the organic esters of cellulose, methacrylate polymers, and copolymers of vinylidene chloride and acrylonitrile, without the necessity of prolonged periods of mixing. According to the process of the present invention, the polymeric thickening agent to be employed is dispersed in an aqueous medium by agitation. The aqueous medium can contain various oxidizers and/or inorganic nitrates in solution. A nitroparaffin is then added to the dispersion where the polymeric thickening agent preferentially migrates to it to form a nitroparaffin gel which is finely dispersed in the aqueous medium. Water gelling agents, fuels and non-explosive sensitizing materials, such as glass microballoons, for example, can then be added to form the explosive gel composition which comprises finely dispersed globules of the nitroparaffin gel. Thus, an explosive gel composition which comprises a nitroparaffin gel within an aqueous gel is formed. The resulting explosive gel has good storage capabilities and can be detonated in a conventional manner.

DETAILED DESCRIPTION OF THE INVENTION

In accordance with one embodiment of the present invention, a polymeric thickening agent is added to an aqueous medium and stirred to produce a dispersion. A nitroparaffin is then added to this dispersion while the dispersion is subjected to agitation and the nitroparaffin quickly migrates to the polymeric thickening agent to form finely divided globules of nitroparaffin gel. Optionally, the nitroparaffin can be added to the aqueous medium first and then the polymeric thickening agent is added, with agitation, to form the dispersed globules of nitroparaffin gel. After formation of the nitroparaffin gel, additional oxidizing agents, fuels and additional sensitizing material can be added to the dispersion. The aqueous phase of the dispersion is then gelled by addition of an effective amount of conventional water gelling agents. It is noted that the term "nitroparaffin gel" as used in the scope of the subject invention is used to describe the thickened material which forms as the result of admixing the polymeric thickening agent and nitroparaffin, such material having a viscosity greater than the nitroparaffin.

At this point, the aqueous medium can contain only water or it can comprise an aqueous solution of one or more oxidizing agents described in detail below. Water will comprise from about 5 to about 25 percent by weight of the explosive gel compositions of the subject invention. In one embodiment of the present invention, the oxidizing agents employed are dissolved in the water prior to formation of the nitroparaffin gel which occurs upon addition of the nitroparaffin to the aqueous medium containing the dispersed polymeric thickening agent. Alternatively, the oxidizing agents can be dissolved in the aqueous medium after the dispersed nitroparaffin gel has been formed. It is also possible to dissolve a portion of the oxidizing agents which are to be employed prior to the formation of the nitroparaffin gel with the balance of the oxidizing agents being added after the nitroparaffin gel has been formed. Regardless of the order of addition, the oxidizing agents employed herein can be dissolved in water to form an aqueous medium at relatively low temperatures, such as room temperature to about 200° F, for example about 125°-135° F.

The explosive gel compositions of the subject invention will contain oxidizing agents in an amount ranging from about 10 to about 90 weight percent, based on the weight of the explosive gel. The oxidizing agents can include a single inorganic nitrate, mixtures of several inorganic nitrates or mixtures of inorganic nitrates with other types of oxidizing agents. Inorganic nitrates which can be employed in the subject invention include nitrates of ammonium, the alkali or alkaline earth nitrates, nitrates of Group III elements and mixtures thereof. Preferred inorganic nitrates include ammonium nitrate and sodium nitrate. Additionally, other oxidizing agents, preferably water soluble salts such as ammonium, the alkali metal or the alkaline earth metal perchlorates, perchlorates of Group III elements and mixtures thereof can be employed. Ammonium perchlorate and sodium perchlorate are preferred among this latter class of oxidizing agents. The explosive gel of the subject invention can include from about 10 to about 80 percent by weight of an inorganic nitrate or mixtures of inorganic nitrates. Other oxidizing agents, such as the aforementioned perchlorates can be present in an amount of from about 0 to about 30 percent by weight of the explosive gel provided that the total oxidizing agent content does not exceed about 90 percent by weight thereof.

The polymeric thickening agent for nitroparaffins which is added to the above described aqueous medium to form a dispersion can be selected from the organic esters of cellulose, methacrylate polymers, and copolymers of vinylidene chloride and acrylonitrile. All of the polymeric thickening agents employed in the subject invention are characterized by a high molecular weight, the ability to thicken nitroparaffins and easy dispersion in an aqueous phase. Generally tne polymers employed as nitroparaffin thickening agents in the present invention have a molecular weight of about 100,000 or greater. These polymeric thickeners are commercial grade products and are utilized in powdered form so as to be easily dispersed in the aqueous phase and quickly soluble in the nitroparaffin when it is added. They can be used separately, or mixtures can be employed. The polymeric thickening agents of the subject invention can be used either alone or in conjunction with other known nitroparaffin thickening agents such as nitrocellulose or cyanoethylether derivatives of galactomannun gum. Additionally, these polymeric thickeners can be used in conjuction with emulsifying or dispersing aids such as those discussed in detail below.

The organic esters of cellulose useful in the present invention as polymeric thickening agents for nitroparaffins include cellulose acetate, cellulose acetate butyrate and cellulose acetate propionate. Mixtures of these three cellulose derivatives may be employed, or these cellulose derivatives may be employed in conjunction with the other polymeric thickening agents of the subject invention or with previously known nitroparaffin thickening agents. Examples of these polymers are those which may be purchased, in powdered form, from Eastman Kodak Company of Rochester, N.Y., under trade designations 394-60, 171-40, and 482-20.

Also useful in the present invention are methacrylate polymers and copolymers, including, methylmethacrylate polymers, ethylmethacrylate polymers and butyl methacrylate polymers. These nitroparaffin polymeric thickening agents, as well as copolymers thereof, can likewise be employed either alone, or in conjunction with the other polymeric thickening agents disclosed herein, or with conventional nitroparaffin thickening agents. Methacrylate polymers useful in the present invention are available in powdered form from Rohm and Haas Company, Philidelphia, Pa., sold under the trade designation "Acryloid".

A third type of polymeric thickening agent which can be employed according to the present invention to thicken nitroparaffins in a one step process, thus alleviating the need for prethickening nitroparaffins or employing extended mixing times, are copolymers of vinylidene chloride and acrylonitrile. The copolymers employed in the present invention generally comprise powdered materials known/as "saran" and are available in microsphere or powdered form from Dow Chemical Company, Midland, Mich. For convenience in mixing, the powdered forms are preferable. This thickening agent can also be used either alone or in conjunction with other thickening agents for the nitroparaffin.

The above described polymeric thickening agents for nitroparaffin can be added to the aqueous medium and stirring or other means of agitation can then be employed to effect relative homogenity of the aqueous medium-nitroparaffin thickening agent dispersion. Generally, the nitroparaffin thickening agents and other dispersion aids for nitroparaffins, are added to the aqueous medium in an amount equal to from about 0.05 to about 2.0 percent by weight, based on the weight of the explosive gel composition.

Once the dispersion of the continuous aqueous medium and the discontinuous polymeric thickening agent phase, comprised of dispersed polymer particles, has been formed, the nitroparaffin is added and the mixture is stirred or otherwise agitated to produce a nitroparaffin gel dispersed within the aqueous medium. This occurs because the agitation disperses the nitroparaffin which contacts the dispersed particles of polymeric thickener to produce the dispersion of the nitroparaffin gel in the aqueous medium. Examples of nitroparaffins which can be used within the scope of this invention include mono nitrated alkanes having from about 1 to about 3 carbon atoms. Examples of these are nitromethane, nitroethane, 1-nitropropane, 2-nitropropane, and mixtures thereof. Nitromethane is the preferred nitroparaffin. The nitroparaffins can be present in the resulting explosive gel in an amount equal to from about 5 to about 30 percent by weight, based on the weight of the explosive gel. The nitroparaffins are preferably present in an amount equal to about 15 percent by weight of the explosive composition.

As discussed above, the nitroparaffin, when added to the polymeric thickening agent dispersion will migrate to the polymeric thickener particles of the dispersion to form nitroparaffin gel globules dispersed throughout the aqueous phase. Once this nitroparaffin gel has formed, gelling agents for the aqueous medium, as well as other additives, including additional oxidizers, fuels, and non-explosive sensitizing materials, for example, can be added either separately or in combination. For example, if only a portion of the oxidizing agents which are to be employed were previously dissolved in the aqueous medium, the remaining portion can be added after the nitroparaffin gel forms in the manner disclosed above.

In addition to oxidizing agents, various fuels non-explosive sensitizing materials and other auxiliary sensitizing agents can also be added. Any conventional oxidizable fuel materials can be employed. Examples of suitable fuels include oxygenated organic compounds such as lower alcohols, esters, ethers, ketones, and aldehydes; and the like. Additionally, powdered or atomized aluminum can be used as a fuel. Ethylene glycol is a preferred fuel. Non-explosive sensitizing materials such as glass or resin microballoons, wood flour, cork or balsa, for example, can be employed by adding these materials along with the aqueous medium thickening agents, fuels, oxidizing agents and other additives. Preferred non-explosive sensitizing materials are glass microballoons. In addition, auxiliary sensitizing agents conventionally employed in water based explosives such as methylamine nitrate, ethylenediamine dinitrate, DNT, and TNT, and mixtures thereof, for example, can be employed. Generally, fuels, such as those described above, need not be present in the explosive gel composition but can be present in the explosive gel composition in any amount up to about 15 weight percent, based on the weight of the explosive gel. The non-explosive sensitizing materials can be present in amounts ranging from 0 to about 5 percent by weight of the explosive gel composition. The auxiliary sensitizing materials may be optionally employed in an amount of up to about 20 percent by weight. The aqueous gelling agents employed can be any conventionally known water gelling agents such as the natural gums such as guar gum or gum arabic, pregelatinized starch, carboxymethyl cellulose, ethyl and propyl ether derivatives of guar gum, polyoxy ethylene, carboxyethyl cellulose, and biopolymeric materials such as xanthan gum, and the like. A preferred gelling agent for the aqueous medium is guar gum which is added along with an effective amount of a crosslinker such as potassium pyroantimonate, sodium dichromate, sodium borate, ferric chloride, or heavy metal ions, and the like. A polyacrylamide can be added as a secondary thickener to provide better flow characteristics depending upon whether the explosive gel composition is to be poured, pumped or applied in some other manner. Optionally a polyacrylamide can be used alone as the aqueous gelling agent and a suitable crosslinker for the polyacrylamide such as aluminum sulfate or aluminum nitrate can be used to obtain the desired consistency. The gelling agents for the aqueous phase are generally present in an amount of from about 0.2 to about 2.0 percent by weight, based on the weight of the explosive gel composition.

In another embodiment of the present invention, emulsifiers for the nitroparaffins to be employed can be added to achieve very fine dispersion of the nitroparaffin within the explosive gel composition. According to this embodiment of the invention, an emulsifying agent, such as a hydrogenated tallow amine is added to the aqueous medium along with the polymeric thickening agents. Upon addition of the nitroparaffin, very small dispersed droplets of nitroparaffin gel are formed and the emulsifier acts to keep the nitroparaffin emulsified, even in a gelled state. This fine dispersion of the globules of nitroparaffin gel within the aqueous medium results in an explosive gel composition which is more sensitive than most comparable types of aqueous explosive gels. A preferred nitroparaffin emulsifier which can be used is sold under the trade name Armeen HT, and is a hydrogenated tallow amine sold by Armak Company, Industrial Chemicals Division, Chicago, Ill. Such emulsifiers can be present in the explosive composition in an amount ranging from about 0.01 to about 0.5 weight percent based on the weight of the explosive gel composition.

Thus, according to the present invention, an aqueous gel explosive composition can be prepared without the necessity of prolonged mixing and which utilizes readily available types of nitroparaffin gelling agents. The explosive gel compositions can be prepared by forming an aqueous medium consisting essentially of water or an aqueous solution of oxidizing agents, adding a polymeric thickening agent selected from organic esters of cellulose, methacrylate polymers, and copolymers of vinylidene chloride and acrylonitrile to the aqueous medium to form a dispersion, thereafter admixing a nitroparaffin with the dispersion to form an aqueous dispersion of nitroparaffin gel, and adding fuels, oxidizing agents, nonexplosive sensitizing materials and a water gelling agent to thereby form an explosive composition which basically comprises gelled nitroparaffin globules dispersed within an aqueous gel. The explosive gel compositions produced by this process generally will have a water content of between about 5 to about 25 weight percent based upon the weight of the explosive gel composition. The explosive gel compositions can be detonated in a known manner by conventional booster systems such as for example, Pentalite, Composition B, RDX, and other similar primers in combination with conventional blasting caps. In addition, in some cases, the explosive gel compositions of the present invention are cap sensitive and may be detonated using a No. 6 blasting cap. These cap sensitive explosive gel compositions can be prepared by employing a nitroparaffin emulsifier in the manner discussed above to thereby form more finely dispersed (and therefore more sensitive) globules of nitroparaffin gel within the explosive gel composition, and if desired, aluminum powder. Cap sensitivity can also be achieved without the use of an emulsifier by employing relatively high amounts of nitromethane and obtaining fine dispersion thereof by controlling mixing speed and temperature.

EXAMPLES

The following examples are presented to enable one skilled in the art to more fully understand the present invention. However, it is to be understood that the examples are exemplary only and do not limit the invention in any manner.

EXAMPLE 1

A mixture of 147 grams of ammonium nitrate and 56 grams of sodium nitrate were dissolved in 100 grams of water at 118° F. This aqueous medium was then added to 475 grams of ground ammonium nitrate and stirred. To this slurry-like aqueous medium was added 1 gram of Armeen HT, 3 grams of cellulose acetate sold under the trade designation of 394–60 by Eastman Kodak Company of Rochester, N.Y., along with 20 grams of ethylene glycol with continued stirring. Nitromethane in the amount of 140 grams was then added to the aqueous solution containing the polymeric thickening agent, cellulose acetate. Finely dispersed globules of nitromethane gel formed almost immediately within the aqueous medium. The following materials were than added to the aqueous medium-nitromethane gel dispersion:

| | |
|---|---|
| B38/4000 Glass Microballoons (Manufactured by 3M Corp. Minneapolis, Minn.) | 20 grams |

-continued

| | |
|---|---|
| Jaguar NG (Manufactured by Stein Hall & Co., Inc. New York, N.Y.) dispersed in 10 grams of nitromethane | 7 grams |
| Potassium pyroantimonate | 0.1 gram |
| Alcoa 1620A Atomized Aluminum (Manufactured by Alcoa Aluminum, Pittsburgh, Pa.) | 30 grams |

The resulting explosive gel composition was stored at 70° F for about two weeks without detrimental effect. At the end of the two week period, the explosive gel composition was found to be detonable with a 10 gram Detaprime a PETN containing mini-primer manufactured by E. I. duPont de Nemours & Co., Wilmington, Del., and a No. 6 blasting cap. Further, at the end of three months storage, at approximately 70° F, this composition was found to be detonable in 2¾ inches diameter with a No. 6 blasting cap alone.

EXAMPLE 2

A mixture of 147 grams of ammonium nitrate and 56 grams of sodium nitrate were dissolved in 100 grams of water at 135° F. Ammonium nitrate in an amount of 475 grams was then added with stirring. Cellulose acetate butyrate sold under the trade designation 171-40 by Eastman Kodak Company, Rochester, N.Y., and 1 gram of Armeen HT sold by Armak Company, Chicago, Ill., was added to the aqueous medium with stirring and was found to disperse easily. Ethylene glycol in the amount of 20 grams was also added with stirring. Under agitation, 140 grams of nitromethane was added to the aqueous medium and finally dispersed globules of nitromethane gel were observed to form almost immediately within the aqueous medium. The following oxidizing agents, non-explosive sensitizing materials and water gelling agents were then added to the dispersion:

| | |
|---|---|
| B38/4000 Glass Microballoons (Manufactured by 3M Corp. (Minneapolis, Minn.) | 20 grams |
| Jaguar NG (Manufactured by Stein Hall & Co., Inc., New York, N.Y.) dispersed in 10 grams of nitromethane | 7 grams |
| Potassium pyroantimonate | 0.1 gram |
| Alcoa 1620A Atomized Aluminum (Manufactured by Alcoa Aluminum, Pittsburg, Pa.) | 30 grams |

The explosive composition so manufactured was stored for about two weeks at about 70° F and was found to be detonable with a 10 gram Detaprime, as described in Example 1, in conjunction with a No. 6 blasting cap.

EXAMPLE 3

The procedures and materials of Examples 1 and 2 were repeated except that 3 grams of cellulose acetate propionate, sold under trade designation 482-20 by Eastman Kodak Company, Rochester, N.Y., was substituted in place of the cellulose acetate employed in Example 1 and the cellulose acetate butyrate employed in Example 2. Also, a temperature of about 160° F was employed while forming the aqueous solution of oxidizing salts. The resulting explosive composition, containing the oxidizing agents, non-explosive sensitizing materials, and fuels in the amounts listed in Examples 1 and 2 were also incorporated into the explosive composition of this Example. The resulting explosive composition was found to be detonatable with a 10 gram Dataprime and a No. 6 blasting cap after approximately a two week storage period, during which temperatures averaged approximately 70° F.

EXAMPLE 4

A mixture of 147 grams of ammonium nitrate and 56 grams of sodium nitrate were dissolved in 100 grams of water at 160° F. To this solution was added 475 grams of ground ammonium nitrate with stirring. Armeen HT, a hydrogenated tallow amine emulsifying agent sold by Armak Company, Chicago, Ill., and 3 grams of dried, unexpanded saran microspheres sold under the designation XD8168 by Dow Chemical Company, Midland, Mich., were then added with continued stirring. Upon addition of 140 grams of nitromethane a nitromethane gel in the form of finely dispersed globules were observed to form almost immediately. The following materials were then added in the amount and order stated:

| | |
|---|---|
| B38/4000 Glass Microballoons (Manufactured by 3M Corp. Minneapolis, Minn.) | 20 grams |
| Jaguar NG (Manufactured by Stein Hall & Co., Inc. New York, N.Y.) dispersed in 10 grams of nitromethane | 7 grams |
| Potassium pyroantimonate | 0.1 gram |
| Alcoa 1620A Atomized Aluminum (Manufactured by Alcoa Aluminum, Pittsburgh, Pa.) | 30 grams |

The resulting explosive gel composition exhibited good storage capabilities and after a two week period at approximately 70° F was found to be detonable with a 2 × 8 inch stick of Power Primer, a high strength gelatin dynamite manufactured by Atlas Powder Co., Tamaqua, Pa., and a No. 6 blasting cap.

EXAMPLE 5

Sodium nitrate in the amount of 56 grams and ammonium nitrate in the amount of 625 grams were dissolved in 100 grams of water and cooled to about 140° F. To this aqueous solution was added 1 gram Armeen HT, and 1 gram of Acryloid K120N, a methyl-methacrylate polymer in powder form, sold by Rohm & Hass Company, Philadelphia, Pa., with stirring. The methyl-methacrylate polymer dispersed easily in the aqueous solution. With continued stirring 140 grams of nitromethane was added and finely dispersed globules of gelled nitromethane were observed to form almost immediately. The following fuels, oxidizing agents, non-explosive sensitizing materials and water gelling agents were than added in the proportions stated:

| | |
|---|---|
| B38/4000 Glass Microballons (Manufactured by 3M Corp. Minneapolis, Minn.) | 20 grams |
| Ethylene Glycol | 20 grams |
| Jaguar NG (Manufactured by Stein Hall & Co., Inc., New York, N.Y.) | 7 grams |
| Alcoa 1620A Atomized Aluminum (Manufactured by Alcoa Aluminum, Pittsburgh, Pa.) | 30 grams |
| Potassium Pyroantimonate | 0.1 gram |

The resulting gel explosive composition was stored for a period of six weeks at approximately 70° F. A 2 inch diameter sample of this explosive gel composition was found to be detonable with one 10 gram Detaprime, as described in Example 1, above.

EXAMPLE 6

A mixture of 74 grams sodium nitrate, 26 grams sodium perchlorate, and 463 grams of ammonium nitrate was dissolved in 180 grams of water and heated to approximately 140° F. To this aqueous solution 5 grams of Acryloid K120N, a methyl-methacrylate polymer sold in powder form by Rohm & Hass Company, Philidelphia, Pa., was added with continued agitation. Nitromethane was then added in an amount of 140 grams and dispersed globules of gelled nitromethane were observed to form quickly within the aqueous medium. The following materials are then added in the amounts specified.

| | |
|---|---|
| Ethylene Glycol | 40 grams |
| B28/750 Glass Microspheres (Manufactured by 3M Corp. Minneapolis, Minn.) | 15 grams |
| Jaguar NG (Manufactured by Stein Hall & Co., Inc., New York, N.Y.) | 7 grams |
| Potassium Pyroantimonate | 0.8 grams |

The resulting explosive gel composition was found to have excellent storage characteristics and a 2 inch diameter sample of this explosive gel composition was detonable with a 2 × 8 inch Power Primer and No. 6 blasting cap after one month of storage.

EXAMPLE 7

A No. 6 cap sensitive aqueous gel explosive composition was prepared according to the subject invention in the following manner. It should be noted that because a fairly large batch was prepared (approximately 150 lbs.) the major constituents were measured in terms of pounds, while the minor constituents were weighed out in grams. First, a mixture of 22 pounds 1 ounce of flaked ammonium nitrate and 8 pounds 6 ounces of sodium nitrate were dissolved in 15 pounds of water at approximately 120° F. This aqueous medium was then added to 72 pounds of ground ammonium nitrate and stirred. To this slurry-like aqueous medium was added 68.1 grams of Armeen HT, 204.3 grams of cellulose acetate sold under the trade designation of 394–60 by Eastman Kodak Company of Rochester, N.Y., along with 3 pounds of ethylene glycol. Nitromethane in the amount of 21 pounds was then added to the aqueous solution containing the polymeric thickening agent, cellulose acetate. Finely dispersed globules of nitromethane gel formed almost immediately within the aqueous medium. The following materials were then added to the aqueous medium-nitromethane gel dispersion:

| | |
|---|---|
| B38/4000 Glass Microballoons (Manufactured by 3M Corp., Minneapolis, Minn.) | 3 pounds |
| Jaguar NG (Manufactured by Stein Hall & Co., Inc., New York, N.Y.) | 354.1 grams |
| Potassium pyroantimonate | 5.05 grams |
| Alcoa 1620A Atomized Aluminum (Manufactured by Alcoa Aluminum, Pittsburgh, Pa.) | 3.5 pounds |

After storage of the above composition for approximately one month, the explosive gel composition was found to be detonable with a No. 6 blasting cap in a 2 inch diameter container.

While this invention has been described in relation to its preferred embodiments, it is to be understood that various modifications thereof will now be apparent to one skilled in the art from reading this specification and it is intended to cover such modifications as fall within the scope of the appended claims.

What is claimed is:

1. A process for preparing an explosive gel composition which comprises an inorganic nitrate and a nitroparaffin comprising:

(a) forming an aqueous solution comprising an inorganic nitrate;

(b) adding a nitroparaffin to said aqueous solution;

(c) adding a polymeric thickening agent for nitroparaffins selected from the group consisting of cellulose acetate, cellulose acetate butyrate, cellulose acetate propionate, polymers of methyl, ethyl and butyl methacrylate, copolymers of vinylidene chloride and acrylonitrile, and mixtures thereof to said aqueous solution while agitating to form a nigroparaffin gel dispersed within said aqueous solution;

(d) gelling said aqueous solution by adding an effective amount of an aqueous gelling agent.

2. The product produced by the process of claim 1.

3. A method for producing an aqueous gel explosive composition comprising:

(a) dispersing a polymeric thickening agent for nitroparaffins selected from the group consisting of cellulose acetate, cellulose acetate butyrate, cellulose acetate propionate, polymers of methyl, ethyl and butyl methacrylate, copolymers of vinylidene chloride and acrylonitrile and mixtures thereof in an aqueous medium by agitation;

(b) thereafter adding a nitroparaffin to said aqueous medium while agitating to form a nitroparaffin gel;

(c) gelling said aqueous medium.

4. The process of claim 3 further comprising admixing a fuel with said aqueous medium containing the dispersed nitroparaffin gel.

5. The process of claim 4 wherein said fuel is present in an amount up to about 15 percent by weight, based on the weight of the explosive gel composition.

6. The process of claim 5 wherein said fuel is selected from the group consisting of aromatic hydrocarbons, petroleum naphthas, oxygenated organic compounds, aluminum and mixtures thereof.

7. The process of claim 6 wherein said fuel is ethylene glycol.

8. The process of claim 3 further comprising admixing a non-explosive sensitizing material with said aqueous medium containing the dispersed nitroparaffin gel.

9. The process of claim 8 wherein said non-explosive sensitizing material is present in an amount up to about 5 percent by weight based on the weight of the explosive gel composition.

10. The process of claim 9 wherein said non-explosive sensitizing material is selected from the group consisting of glass microballoons, resin microballoons, wood flour, cork, balsa and mixtures thereof.

11. The process of claim 10 wherein said non-explosive sensitizing material is glass microballoons.

12. The process of claim 3 wherein said polymeric thickening agent further comprises nitrocellulose.

13. The process of claim 3 wherein said polymeric thickening agent is in powdered form.

14. The process of claim 3 wherein said nitroparaffin is present in an amount equal to from about 5 to about 30 percent by weight, based on the weight of said explosive gel composition.

15. The process of claim 14 wherein said nitroparaffin is selected from the group consisting of nitromethane, nitroethane, 1-nitropropane, 2-nitropropane.

16. The process of claim 15 wherein said nitroparaffin is nitromethane.

17. The process of claim 3 wherein said inorganic nitrate is present in an amount of from about 10 to about 80 percent by weight, based on the weight of said explosive gel composition.

18. The process of claim 17 wherein said inorganic nitrates are selected from the group consisting of nitrates of ammonium, alkali metals, alkaline earth metals, Group III elements and mixtures thereof.

19. The process of claim 18 wherein said inorganic nitrate is a mixture of ammonium nitrate and sodium nitrate.

20. The process of claim 17, further comprising dissolving an oxidizing agent other than said inorganic nitrate in said aqueous medium in an amount up to about 30 percent by weight, based on the weight of the explosive gel composition, so that the combined total of said oxidizing agent and said inorganic nitrate is in the range of from about 10 to about 90 percent by weight of said explosive gel composition.

21. The process of claim 20 wherein said oxidizing agent is selected from the group consisting of the perchlorates of ammonium, alkali metals, alkaline earth metals, Group III elements and mixtures thereof.

22. The process of claim 21 wherein said oxidizing agent is sodium perchlorate.

23. The process of claim 21 wherein said oxidizing agent is ammonium perchlorate.

24. The process of claim 3 wherein said gelling of the aqueous medium is effected by the addition of an aqueous gelling agent in an amount of from about 0.2 to about 2.0 percent by weight, based on the weight of the explosive gel composition.

25. The process of claim 24 wherein said aqueous gelling agent is selected from the group consisting of gum arabic, guar gum, polyacrylamides, pregelatinized starch, carboxyethyl cellulose and mixtures thereof.

26. The process of claim 25 wherein said aqueous gelling agent comprises guar gum and a suitable cross linker therefor.

27. The process of claim 25 wherein said aqueous gelling agent comprises a polyacrylamide and a suitable crosslinker therefor.

28. The process of claim 3 further comprising admixing an effective amount of an emulsifier with said aqueous medium.

29. The process of claim 28 wherein said emulsifier is a hydrogenated tallow amine.

30. The process of claim 3 further comprising admixing an auxiliary sensitizing agent with said aqueous medium containing the dispersed nitroparaffin gel.

31. The process of claim 30 wherein said auxiliary sensitizing agent comprises up to about 20 percent by weight of the explosive gel composition and is selected from the group consisting of methylamine nitrate, ethylenediamine dinitrate, Dinitrotoluene, Trinitrotoluene and mixtures thereof.

32. The product produced by the process of claim 3.

33. In a method of making an aqueous gel explosive composition comprising a nitroparaffin gelled with a polymeric thickening agent selected from the group consisting of cellulose acetate, cellulose acetate butyrate, cellulose acetate propionate, polymers of methyl, ethyl and butyl methacrylate, copolymers of vinylidene chloride and acrylonitrile, and mixtures thereof, the improvement comprising:

dispersing said polymeric thickening agent in an aqueous medium and thereafter adding nitroparaffin to the resulting dispersion with agitation to form a nitroparaffin gel dispersed within said aqueous medium.

34. The method of claim 33 wherein said aqueous medium comprises a solution of oxidizing agents.

35. The method of claim 33 further comprising gelling said aqueous medium.

36. The product produced by the method of claim 33.

37. In a process for producing an aqueous explosive gel composition which comprises a nitroparaffin gel, the improved method of preparing said nitroparaffin gel comprising:

(a) dispersing a polymeric thickening agent for nitroparaffins selected from the group consisting of cellulose acetate, cellulose acetate butyrate, cellulose acetate propionate, polymers of methyl, ethyl and butyl methacrylate, copolymers of vinylidene chloride and acrylonitrile, and mixtures thereof in an aqueous solution by agitating;

(b) adding a nitroparaffin to said aqueous solution while agitating to thereby form dispersed globules of nitroparaffin gel.

38. The product produced by the process of claim 37.

39. A method of manufacturing a gelled explosive material consisting essentially of the following composition:

| Ingredient | % by weight |
|---|---|
| Inorganic nitrate | 10 - 80 |
| Oxidizing Agents (other than inorganic nitrates) | 0 - 30 |
| Water | 5 - 25 |
| Water Gelling Agent | 0.2 - 2.0 |
| Non-explosive Sensitizing Agent | 0 - 5.0 |
| Fuels | 0 - 15 |
| Nitroparaffin | 5 - 30 |
| Polymeric thickner of nitroparaffin selected from the group consisting of cellulose acetate, cellulose acetate butyrate, cellulose acetate propionate, polymers of methyl, ethyl and butyl methacrylate, copolymers of vinylidene chloride and acrylonitrile and mixtures thereof | 0.05 - 2.0 |

said gelled explosive material being formed by adding said polymeric thickner to an aqueous medium selected from the group consisting of water and an aqueous solution containing at least a portion of said inorganic nitrates and thereafter adding the remaining ingredients.

40. The method of claim 39 further comprising admixing an effective amount of an emulsifier with said aqueous medium.

41. The method of claim 40 wherein said emulsifier is a hydrogenated tallow amine.

42. The method of claim 41 wherein said polymeric thickening agent is in powdered form.

43. The method of claim 39 wherein said nitroparaffin is nitromethane.

44. The method of claim 39 wherein said inorganic nitrate is selected from the group consisting of nitrates of ammonium, alkali metals, alkaline earth metals, Group III elements, and mixtures thereof.

45. The method of claim 39 wherein said oxidizing agents are selected from the group consisting of sodium perchlorates, ammonium perchlorates and mixtures thereof.

46. The method of claim 39 wherein said water gelling agent is selected from the group consisting of guar gum, polyacrylamide and mixtures thereof.

47. The method of claim 39 wherein said fuel is selected from the group consisting of ethylene glycol, aluminum and mixtures thereof.

48. The method of claim 39 wherein said non-explosive sensitizing agent is glass microballons.

49. The product produced by the method of claim 39.

* * * * *

UNITED STATES PATENT AND TRADEMARK OFFICE

CERTIFICATE OF CORRECTION

PATENT NO. : 4,097,316

DATED : June 27, 1978

INVENTOR(S) : John J. Mullay

It is certified that error appears in the above-identified patent and that said Letters Patent are hereby corrected as shown below:

Column 3, line 38, change "tne" to --the--.

Column 8, lines 37 and 38, change "2 x 8 inch" to --2" x 8"--.

Column 9, line 32, change "2 x 8 inch" to --2" x 8"--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*